US008644724B2

(12) United States Patent
Nakano et al.

(10) Patent No.: US 8,644,724 B2
(45) Date of Patent: Feb. 4, 2014

(54) IMAGE FORMING DEVICE

(75) Inventors: Hiroshi Nakano, Aichi (JP); Masato Makino, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 122 days.

(21) Appl. No.: 13/156,619

(22) Filed: Jun. 9, 2011

(65) Prior Publication Data

US 2012/0027449 A1 Feb. 2, 2012

(30) Foreign Application Priority Data

Jul. 27, 2010 (JP) ..... 2010-167949

(51) Int. Cl.
*G03G 21/00* (2006.01)

(52) U.S. Cl.
USPC ..... 399/98; 399/121

(58) Field of Classification Search
USPC ..... 399/18, 30, 41, 47, 49, 60, 64, 98, 176, 399/239, 279, 313, 357
See application file for complete search history.

(56) References Cited

U.S. PATENT DOCUMENTS 4,021,894 A * 5/1977 Poterala et al. ..... 26/105
5,819,140 A * 10/1998 Iseki et al. ..... 399/165
5,854,958 A * 12/1998 Tanimoto et al. ..... 399/49

FOREIGN PATENT DOCUMENTS

JP 05-238581 A 9/1993
JP 2000-072272 A 3/2000
JP 2000-072272 A * 3/2000 ..... G03G 15/00
JP 2002-130252 A 5/2002
JP 2002-130253 A 5/2002
JP 2002-130254 A 5/2002
JP 2006-315839 A 11/2006
JP 2010-044252 A 2/2010

* cited by examiner

*Primary Examiner* — Clayton E Laballe
*Assistant Examiner* — Jas Sanghera
(74) *Attorney, Agent, or Firm* — Banner & Witcoff, Ltd.

(57) ABSTRACT

An image forming device, comprising: an endless belt stretched by a plurality of rollers; and a detection sensor located to face one of the plurality of rollers while sandwiching the endless belt between the detection sensor and the one of the plurality of rollers, the detection sensor reading information formed on the endless belt through use of reflection of light. A recessed part is formed, to catch foreign particles, on the one of the plurality of rollers at a position which is shifted in an axis direction of the one of the plurality of rollers with respect to a detection area on the endless belt to which light from the detection sensor is irradiated.

8 Claims, 4 Drawing Sheets

IMAGE FORMING DEVICE

CROSS-REFERENCE TO RELATED APPLICATION

This application claims priority under 35 U.S.C. §119 from Japanese Patent Application No. 2010-167949, filed on Jul. 27, 2010. The entire subject matter of the application is incorporated herein by reference.

BACKGROUND

1. Technical Field

Aspects of the present invention relate to an image forming device provided with a detection sensor which reads information formed on a belt.

2. Related Art

Image forming devices capable of executing color shift correction have been used. Specifically, the image forming device includes an endless belt stretched between two rollers and a detection sensor which detects a patch formed with toner on the endless belt through use of reflection of light, and the color shift correction is performed by detecting the patch through the detection sensor. Since it is preferable to detect a stable place on the endless belt through the detection sensor, the detection sensor is arranged at a position facing the roller while sandwiching the endless belt between the detection sensor and the roller.

However, if foreign particles such as toner invade into a position between the roller and the endless belt and thereby the place on the endless belt to be detected is lifted, a faulty detection by the detection sensor might occur.

SUMMARY

Aspects of the present invention are advantageous in they provide an image forming device capable of preventing occurrence of a faulty detection by a detection sensor.

According to an aspect of the invention, there is provided an image forming device, comprising: an endless belt stretched by a plurality of rollers; and a detection sensor located to face one of the plurality of rollers while sandwiching the endless belt between the detection sensor and the one of the plurality of rollers, the detection sensor reading information formed on the endless belt through use of reflection of light. A recessed part is formed, to catch foreign particles, on the one of the plurality of rollers at a position which is shifted in an axis direction of the one of the plurality of rollers with respect to a detection area on the endless belt to which light from the detection sensor is irradiated

BRIEF DESCRIPTION OF THE ACCOMPANYING DRAWINGS

DETAILED DESCRIPTION

Hereafter, an embodiment according to the invention will be described with reference to the accompanying drawings. In the following, first a general configuration of a color printer (an example of an image forming device) is explained, and thereafter features of the color printer are explained in detail.

Figure 1:
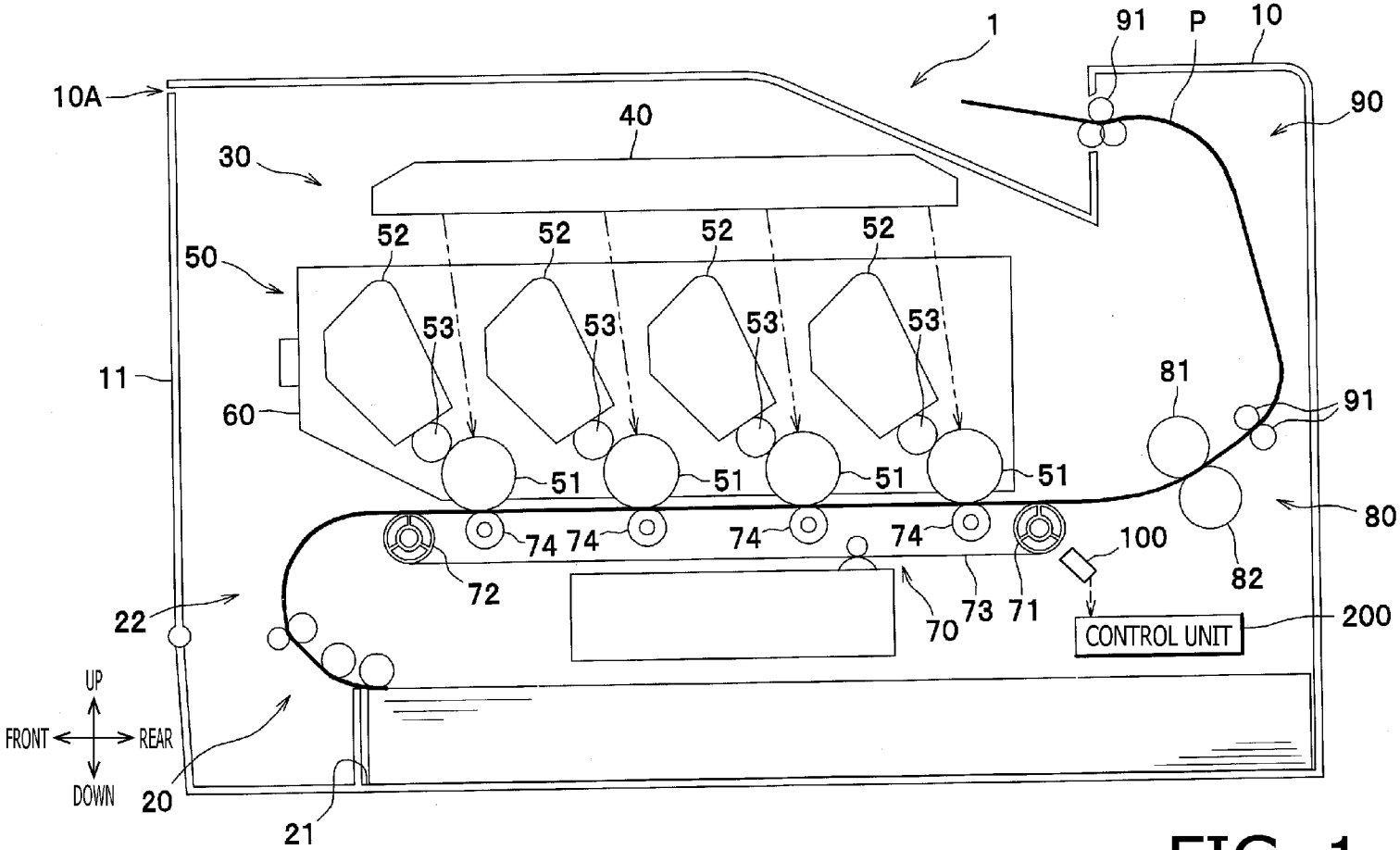
FIG. 1 illustrates a general configuration of a color printer according to an embodiment.

In the following explanation, directions are defined with respect to a user's position defined when the user uses the color printer. That is, the left side on FIG. 1 is defined as a "front side", the right side on FIG. 1 is defined as a "rear side", a far side on FIG. 1 is defined as a "left side", and a near side on FIG. 1 is defined as a "right side". An up and down direction on FIG. 1 is defined as a vertical direction.

As shown in FIG. 1, a color printer 1 according to the embodiment includes, in a main body 10, a paper supply unit 20 which supplies a sheet of paper P, an image formation unit 30 which forms an image of the supplied sheet of paper P, and a paper ejection unit 90 to which the sheet of paper P on which the image has been formed is ejected. The paper supply unit 20 includes a paper supply tray 21 which accommodates the sheets of paper P, and a paper carrying unit 22 which carries the sheet of paper P from the paper supply tray 21 to the image formation unit 30.

The image formation unit 30 includes a scanning unit 40, a process unit 50, a belt unit 70 and a fixing unit 80.

The scanning unit 40 is located in an upper portion of the main body 10. The scanning unit 40 includes a laser emission unit, a polygonal mirror, a lens and a reflection mirror (not shown). The scanning unit 40 emits laser beams to scan on surfaces of respective photosensitive drums 51 of the process unit 50 at a high speed.

The process unit 50 is configured such that, through an opening 10A which is formed by opening a front cover 11 provided on the front face of the main body 10, the process unit 50 can be detachable attachable to the main body 10. The process unit 50 includes a drawer 60, four photosensitive drums 51 rotatably attached by the drawer 60, and four development cartridges 52 provided respectively for the photosensitive drums 51 to be detachably attachable to the drawer 60.

Each photosensitive drum 51 is arranged to be along with a predetermined direction (the front and rear direction) in the state where the process unit 50 is attached to the main body 10. On the drawer 60, various components such as a charger are provided. In each development cartridge 52, a development roller 53 for supplying toner to the photosensitive drum 51 is rotatably provided. Further, in each development cartridge 52, various components, such as a toner reservoir and a supply roller having known structures, are provided.

The belt unit 70 is provided between the process unit 50 and the paper supply unit 20. The belt unit 70 includes a drive roller 71, a driven roller 72, a carrying belt 73 and transfer rollers 74. The drive roller 71 and the driven roller 72 are arranged to be away from each other. The carrying belt 73 is stretched between the drive roller 71 and the driven roller 72. By inputting a driving force from a motor (not shown) to the drive roller 71, the carrying belt 73 and the driven roller 72 rotate to follow rotation of the drive roller 71.

The carrying belt 73 is arranged to contact an outer circumferential surface of each photosensitive drum 51. In the inner portion of the carrying belt 73, the four transfer rollers 74 are arranged to face the photosensitive drums 51, respectively, so as to sandwich the carrying belt 73 between the transfer rollers 74 and the photosensitive drums 51. A transferring bias is applied to the transfer rollers 74 when a transferring process is performed.

The fixing unit 80 is arranged on the rear side of the process unit 50 and the belt unit 70. The fixing unit 80 includes a heat roller 81, and a pressure roller 82 which is located to face the heat roller 81 to press the heat roller 81.

In the image formation unit 30 configured as described above, first the surface of each photosensitive drum 51 is charged uniformly by each charger, and is exposed by the scanning unit 40. As a result, the potential of an exposed portion on the surface of each photosensitive drum 51 decreases. Consequently, an electrostatic latent image corresponding to image data is formed on each photosensitive drum 51.

Then, the toner in the development cartridge 52 is supplied to the electrostatic latent image on each photosensitive drum 51. As a result, a toner image is formed on each photosensitive drum 51.

Next, by causing the sheet of paper P supplied on the carrying belt 73 to pass between each photosensitive drum 51 and each transfer roller 74, the toner image formed on each photosensitive drum 51 is transferred to the sheet of paper P. Then, by causing the sheet of paper O to pass between the heat roller 81 and the pressure roller 82, the toner image formed on the sheet of paper P is heat-fixed.

The paper ejection unit 90 includes a plurality of rollers 91 to carry the sheet of paper P. The sheet of paper P on which the toner image has been heat-fixed is carried by the carrying rollers 91, and is ejected to the outside of the main body 10.

Hereafter, a configuration of the drive roller 71 which is the feature of the embodiment is explained in detail. Before explaining the drive roller 71, detection sensors 100 and a control unit 200 are explained with reference to FIG. 1.

Each detection sensor 100 is a sensor which reads a patch formed on the carrying belt 73 through use of reflection of light. Each detection sensor 100 is located under the drive roller 71 at a position which is obliquely downward with respect to the drive roller 71. Specifically, the detection sensor 100 is arranged to face the drive roller 81 while sandwiching the carrying belt 73 between the drive roller 71 and the detection sensor 100.

Figure 2A:
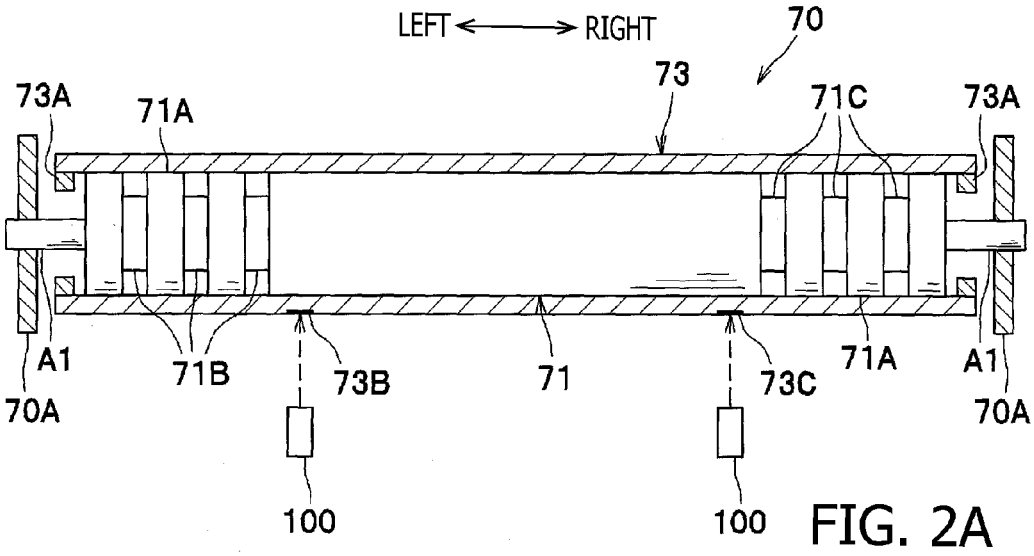
FIG. 2A is a cross section illustrating recessed parts formed on a drive roller.

As shown in FIG. 2A, two detection sensors 100 are arranged to have a certain interval in the left and right direction (i.e., in the axis direction of the drive roller 71). Specifically, the detection sensors 100 are located at positions shifted from both edges of the carrying belt 73 and from the center of the carrying belt 73 in the left and right direction. With this configuration, light from the detection sensors 100 impinges on the carrying belt 73 at areas (detection areas 73B and 73C) shifted from both edges of the carrying belt 73 and from the center of the carrying belt 73 in the left and right direction.

As shown in FIG. 1, the information detected by each detection sensor 100 is inputted to the control unit 200. When the control unit 200 receives a signal instructing execution of a color shift correction, the control unit 200 controls the carrying belt 73 to perform idle running (i.e., to rotate without carrying the sheet of paper P), directly prints toner of respective colors on the carrying belt 73 through the respective photosensitive drums 53, and detects the toner (a patch) thorough the detection sensors 100 so as to execute the color shift correction.

As shown in FIG. 2A, the drive roller 71 is located, in the left and right direction, on the inner side of respective ring-like restriction members 73A fixed at the both edges on the inner surface of the carrying belt 73. At both edge parts 71A of the drive roller 71, three recessed parts 71B and three recessed parts 71C are provided. On the both edge faces of the drive roller 71, a rotation shaft A1 is formed to extend outward in the left and right direction with respect to the carrying belt 73 so that the rotation shaft A1 is rotatably supported by a frame 70A of the belt unit 70.

Figure 2B:
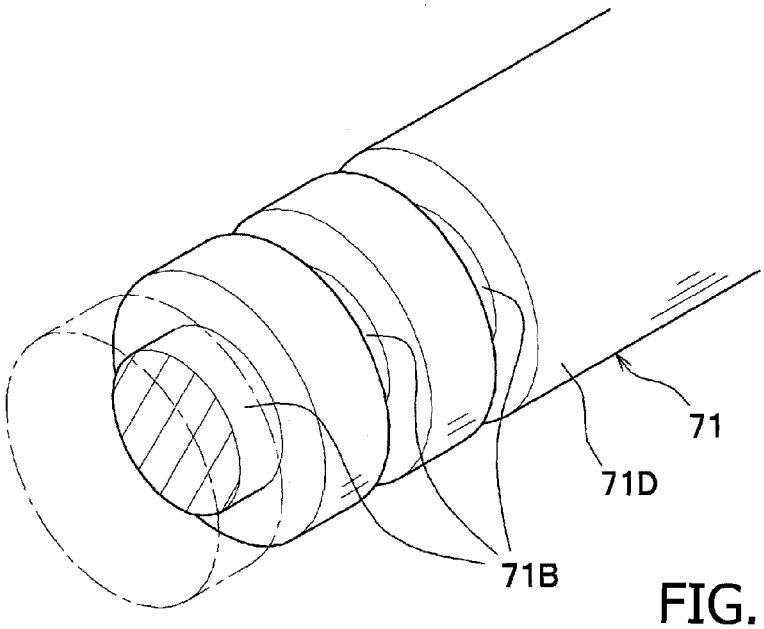
FIG. 2B is a perspective view illustrating the recessed parts formed on the drive roller.

The three recessed parts 71B of the left edge portion of the drive roller 71 are located on the left side with respect to the left detection area 73B, and are separately arranged to have intervals therebetween in the left and right direction. Furthermore, the three recessed parts 71C of the right edge portion of the drive roller 71C are located on the right side with respect to the right detection area 73C, and are separately arranged to have intervals therebetween in the left and right direction. As shown in FIG. 2B, each recessed part 71B (71C) is formed to extend along the circumferential direction of the drive roller 71 to surround the outer circumferential surface 71D of the drive roller 71.

With the above described configuration, the following advantages are achieved.

Since the recessed parts 71B and 71C are formed at positions different from the positions of the detection areas 73B and 73C of the carrying belt 73 in the left and right direction (i.e., the axis direction of the drive roller 71), it is possible to catch foreign particles by the recessed parts 71B and 71C. Such a configuration makes it possible to prevent the foreign particles from entering into the space between the drive roller 71 and each of the detection areas 73B and 73C and thereby to prevent each of the detection areas 73B and 73C from having a protruded shape. As a result, it is possible to prevent occurrence of a faulty detection by each detection sensor 100.

The pressed parts 71B and 71C are formed along the circumferential direction of the drive roller 71. Such a configuration makes it possible to prevent the foreign particles from moving in the inner parts of the recessed parts 71B and 71C in the axial direction in comparison with the case where each of recessed parts (71B and 71C) is formed to extend in the axis direction. Such a configuration also makes it possible to prevent the foreign particles from rapidly moving in each recessed part in the axis direction and thereby invading into the recessed parts 71B and 71C.

Since each of the recessed parts 71B and 71C is formed to make a round on the outer circumferential surface 71D of the drive roller 71, it is possible to catch the foreign particles by the recessed parts 71B and 71C even if the foreign particles invade into recessed parts 71B and 71C from all the directions. Furthermore, since each of the recessed parts 71B and 71C is formed to make a round on the outer circumferential surface 71D of the drive roller 71, each of the recessed parts 71B and 71C can be formed with a lathe on a outer circumferential surface of the drive roller 71 having a shape of a column.

Since a plurality of recessed parts (71B and 71C) are formed in the axis direction, it is possible to more securely prevent the foreign particles from invading into the detection areas 73B and 73C.

As described above, a plurality of individual recessed parts 71B (71C) are provided to have intervals therebetween in the axis direction. That is, the recessed parts 71B do not have a continuous shape. Such a configuration makes it possible to more securely prevent the foreign particles from approaching to the detection areas 73B and 73C, for example, in comparison with the case where a recessed part is formed to have a continuous shape such as a spiral shape. Therefore, it becomes possible to more securely prevent the foreign particles from invading into the detection areas 73B and 73C.

Since the recessed parts 73B and 73C are formed at the both edges 71A of the drive roller 71, it is possible to more securely prevent the foreign particles from invading into the detection areas 73B and 73C from the both edges of the drive roller 71.

Although the present invention has been described in considerable detail with reference to certain preferred embodiments thereof, other embodiments are possible.

Figure 3:
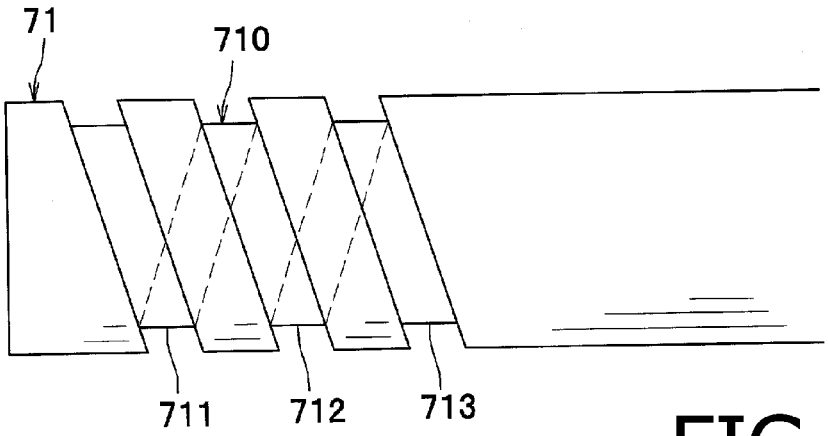
FIG. 3 is an example of a recessed part formed to have spiral shape.
Figure 4:
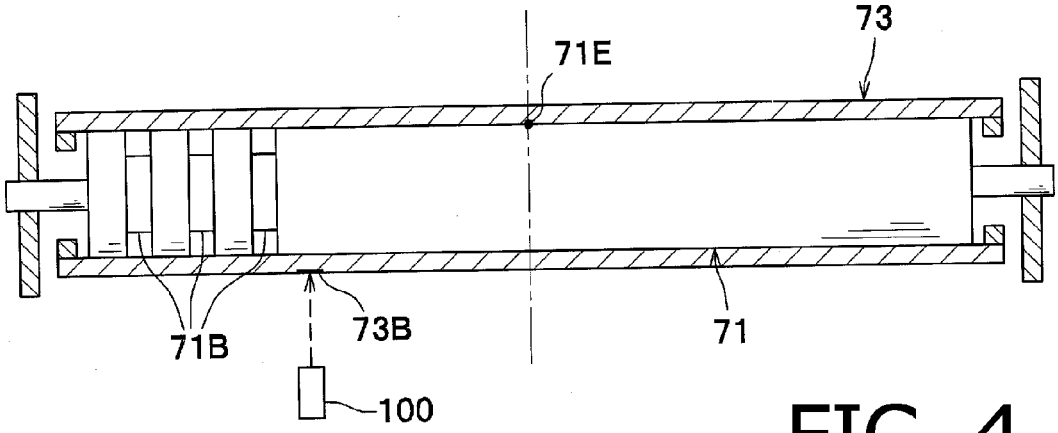
FIG. 4 illustrates another example where recessed parts are formed on one end part of a drive roller.

In the above described embodiment, the recessed parts 71B and 71C are separately arranged to have intervals therebetween in the axis direction. However, the present invention is not limited to such a configuration. For example, as shown in FIG. 3, a recessed part 710 having a spiral shape may be formed on the drive roller 71. That is, recessed parts 711 and 712 each of which is a spiral corresponding to one rotation and a recessed part 713 which is a spiral corresponding to a half of a rotation may be continuously connected to each other.

In the above described embodiment, two detection sensors 100 are provided. The resent invention is not limited to such a configuration. For example, the number of detection sensors may be one. Alternatively, three or more detection sensors may be provided. In particular, in the case where only one detection sensor 100 is provided on the left side of the central part 71E of the drive roller 71, it is preferable that recessed parts 71B are provided on the left side of the detection area 73B for the detection sensor 100. In this case, the recessed part 71B is provided, in the axis direction, on a side where a distance between the detection area 73B and an edge of the drive roller 71 becomes shorter in comparison with a distance between the detection area 73B and the other edge of the drive roller 71 on the other side. That is, the recessed part 71B is provided, in the axis direction, on a side where the foreign particles easily invade into the detection area 73B in comparison with the other side. Such a configuration makes it possible to prevent a recessed part from being uselessly provided on the side, in the axis direction, where the foreign particles are hard to enter the recessed part. As a result, cost reduction can be achieved.

In the above described embodiment, powdery toner is directly adhered to the carrying belt to form information on the carrying belt. However, the present invention is not limited to such a configuration. For example, a sheet of paper on which information is formed may be placed on a carrying belt. In this case, a patch is formed on the sheet of paper being carried on the belt with liquid toner, and the patch formed on the sheet of paper is detected by a detection sensor so as to execute the color shift correction. The feature of the above described embodiment can also be applied to such a configuration. However, because the powdery toner tends to become the foreign particles, the feature of the above described embodiment (i.e., the recessed parts) can be effectively utilized for the case where the powdery toner is used in comparison with the case where the liquid toner is used.

Figure 5A:
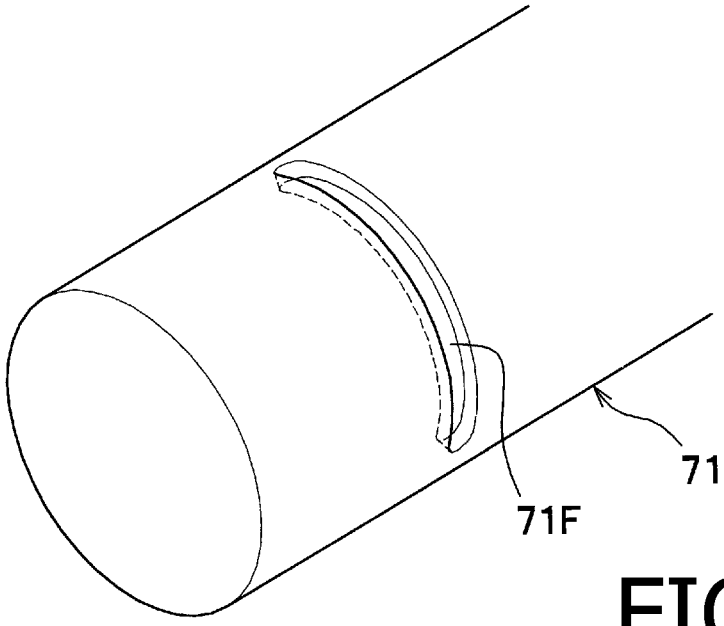
FIG. 5A is a perspective view illustrating another example where a recessed part formed to make a substantially half round of a drive roller is formed in the drive roller.

In the above described embodiment, each of the recessed parts 71B and 71C is formed to make a round on the outer circumferential surface 71D of the drive roller 71. However, the present invention is not limited to such a configuration. For example, as shown in FIG. 5A, a recessed part 71F formed as a part of a circle (i.e., a recessed part formed not to make a round) may be provided along the circumferential direction of the drive roller 71. In this case, a plurality of recessed parts each of which has a shape of a part of a circle may be provided in the axis direction, and the recessed parts may be arranged to be shifted with respect to each other in the circumferential direction so that the recessed parts make a round in combination.

Figure 5B:
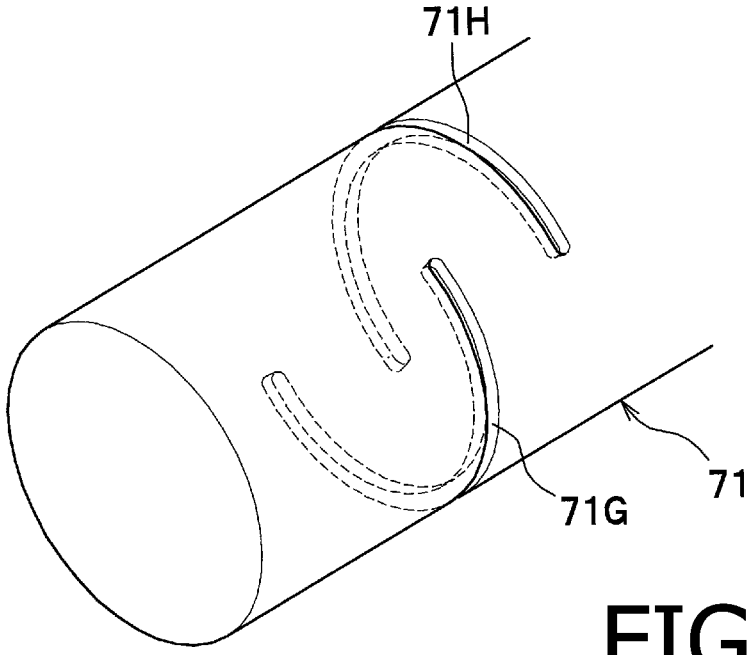
FIG. 5B is a perspective view of another example where recessed parts each of which is formed to make a substantially half round of the drive roller are formed on the drive roller.

That is, as shown in FIG. 5B, when recessed parts 71G and 71H each of which is formed to be longer than a half circle are arranged to have an interval therebetween in the axis direction, the recessed parts 71G and 71H may arranged to partially overlap with each other when viewed along the axis direction. In this case, it is also possible to achieve the same advantages as those of the above described embodiment. That is, it is possible to catch the foreign particles even when the foreign particles invading into the drive roller 71 from any of the positions along the circumferential direction of the drive roller 71.

In the above described embodiment, the carrying belt 73 is employed as a belt for carrying the sheet of paper P. However, the present invention is not limited to such a configuration. For example, a intermediate transfer belt on which toner is directly printed from a photosensitive drum during a print control process may be employed. The configuration regarding rollers on which the belt is stretched is not limited to the above described configuration. For example, three or more rollers on which the belt is stretched may be provided.

In the above described embodiment, the recessed parts 71B and 71C are formed on the drive roller 71. However, the present invention is not limited to such a configuration. For example, when a detection sensor is provided to face the driven roller, the recessed parts may be formed on the driven roller.

In the above described embodiment, the disclosed feature is applied to the color printer 1. However, the present invention is not limited to such a configuration. For example, the disclosed feature may be applied to various types of image forming devices, such as a copying device and a multifunction device.

What is claimed is:

1. An image forming device, comprising:

an endless belt stretched by a plurality of rollers; and a detection sensor located to face one of the plurality of rollers while sandwiching the endless belt between the detection sensor and the one of the plurality of rollers, the detection sensor configured to read information formed on the endless belt through use of reflection of light, wherein a recessed part is formed, to catch foreign particles, on the one of the plurality of rollers at a position which is shifted apart from, in an axis direction of the one of the plurality of rollers, a detection area on the endless belt to which light from the detection sensor is configured to be irradiated, and wherein the detection area of the belt corresponds to, in the axis direction, a non-recessed portion of the one of the plurality of rollers.

2. The image forming device according to claim 1, wherein the recessed part is formed to be along a circumferential direction of the one of the plurality of rollers.

3. The image forming device according to claim 2, wherein the recessed part is formed to make a round on an outer circumferential surface of the one of the plurality of rollers.

4. The image forming device according to claim 2, wherein:

a plurality of recessed parts are formed, to catch foreign particles, on the one of the plurality of rollers at positions which are shifted apart from, in the axis direction of the one of the plurality of rollers, the detection area; and the plurality of recessed parts are arranged in the axis direction.

5. The image forming device according to claim 4, wherein the plurality of recessed parts are provided separately to be away from each other.

6. The image forming device according to claim 1, wherein:

the detection area is located at a position shifted, to one end of the one of the plurality of rollers, from a central part of the one of the plurality of rollers; and the recessed part is formed at the position shifted to the one end of the one of the plurality of rollers with respect to the detection area.

7. The image forming device according to claim 1, wherein:

at least two recessed parts are formed, to catch foreign particles, on the one of the plurality of rollers at positions which are shifted apart from, in the axis direction of the one of the plurality of rollers, the detection area; and the two recessed parts are formed at both end parts of the one of the plurality of rollers, respectively.

8. The image forming device according to claim 1, wherein the information is formed on the endless belt by causing a powdery developer to adhere to the endless belt.

* * * * *